US009640094B2

(12) United States Patent
Trinh et al.

(10) Patent No.: US 9,640,094 B2
(45) Date of Patent: May 2, 2017

(54) SHELF SIGN HOLDER

(71) Applicant: Target Brands, Inc., Minneapolis, MN (US)

(72) Inventors: Nick Q. Trinh, Minneapolis, MN (US); Judd S. Kivi, Minneapolis, MN (US); Kristin A. Dougherty, Chaska, MN (US)

(73) Assignee: Target Brands, Inc., Minneapolis, MN (US)

( * ) Notice: Subject to any disclaimer, the term of this patent is extended or adjusted under 35 U.S.C. 154(b) by 421 days.

(21) Appl. No.: 14/445,544

(22) Filed: Jul. 29, 2014

(65) Prior Publication Data

US 2016/0035256 A1 Feb. 4, 2016

(51) Int. Cl.
*G09F 7/18* (2006.01)
*G09F 23/06* (2006.01)

(52) U.S. Cl.
CPC ..... *G09F 7/18* (2013.01); *G09F 23/06* (2013.01); *G09F 2007/1856* (2013.01); *G09F 2007/1873* (2013.01)

(58) Field of Classification Search
CPC . G09F 3/20; G09F 3/201; G09F 3/204; G09F 7/18; G09F 23/06; G09F 2007/1856; G09F 2007/1873
See application file for complete search history.

(56) References Cited

U.S. PATENT DOCUMENTS

| | | | | |
|---|---|---|---|---|
| 1,110,038 | A | 9/1914 | Burns | |
| 2,206,522 | A * | 7/1940 | Varon | G09F 3/20 40/658 |
| 4,051,615 | A * | 10/1977 | Gosanko | G09F 1/10 40/661 |
| 4,713,899 | A * | 12/1987 | Fast | G09F 3/20 211/57.1 |
| 4,722,147 | A | 2/1988 | Gieske et al. | |
| D298,553 | S | 11/1988 | Zobitz | |
| 5,018,287 | A * | 5/1991 | Fast | G09F 3/204 206/459.5 |
| D328,473 | S | 8/1992 | Mayden | |
| 5,444,929 | A | 8/1995 | Joseloff | |
| 5,992,072 | A | 11/1999 | Garfinkle | |
| 6,408,554 | B1 | 6/2002 | Przylucki | |

(Continued)

OTHER PUBLICATIONS

Office Action from Canadian Patent Application No. 2,877,716, mailed Mar. 20, 2015 (4 pages).

(Continued)

*Primary Examiner* — Gary C Hoge
(74) *Attorney, Agent, or Firm* — Leanne Taveggia Farrell; Westman, Champlin & Koehler, P.A.

(57) ABSTRACT

A sign holder includes a sign sleeve having a width and being defined by a viewing flange, a base flange and a first joint that couples the viewing flange to the base flange. At least one protruding member has a width and is coupled to and extends from the base flange at an at least one second joint. Each protruding member includes a leg portion and at least two hook portions coupled to the leg portion at an at least one third joint. The leg portion is oriented relative to the base flange by a first angle and each hook portion is oriented relative to the leg portion by a second angle. The width of the sign sleeve is greater than the width of the at least one protruding member.

20 Claims, 20 Drawing Sheets

(56) References Cited

U.S. PATENT DOCUMENTS

| | | | | |
|---|---|---|---|---|
| 6,470,613 | B1 * | 10/2002 | Wildrick | G09F 3/20 40/649 |
| 6,811,044 | B2 | 11/2004 | Walker | |
| 6,976,331 | B2 | 12/2005 | Fast | |
| 7,216,445 | B2 | 5/2007 | Bruegmann | |
| 7,314,009 | B2 | 1/2008 | Wunsh et al. | |
| 7,627,971 | B2 | 12/2009 | Fast | |
| 8,668,171 | B2 | 3/2014 | Tarantino et al. | |
| 2006/0254106 | A1 * | 11/2006 | Fast | G09F 3/204 40/661.03 |
| 2009/0001037 | A1 | 1/2009 | Wilcock | |
| 2011/0239501 | A1 | 10/2011 | Ricci et al. | |
| 2012/0073174 | A1 * | 3/2012 | Bird | G09F 3/204 40/661 |
| 2015/0068086 | A1 * | 3/2015 | Theisen | G09F 3/204 40/661.06 |

OTHER PUBLICATIONS

Office Action from Canadian Patent Application No. 2,877,716, mailed Jul. 23, 2015 (3 pages).

* cited by examiner

SHELF SIGN HOLDER

BACKGROUND

Businesses use a variety of types of display structures to present products and related information to customers for purchase. These display fixtures support both products and sign holders. Sign holders receive in-store marketing signs including printed material indicating information about the product and the product price.

The discussion above is merely provided for general background information and is not intended to be used as an aid in determining the scope of the claimed subject matter.

SUMMARY

A sign holder includes a sign sleeve having a width and being defined by a viewing flange, a base flange and a first joint that couples the viewing flange to the base flange. At least one protruding member has a width and is coupled to and extends from the base flange at an at least one second joint. Each protruding member includes a leg portion and at least two hook portions coupled to the leg portion at an at least one third joint. The leg portion is oriented relative to the base flange by a first angle and each hook portion is oriented relative to the leg portion by a second angle. The width of the sign sleeve is greater than the width of the at least one protruding member.

A sign holder includes a single, continuous piece of sheet material having a first surface and an opposing second surface. The sheet material includes a main panel and a return panel. The return panel is fixed to the main panel by a first bend and extends from the first bend to a free end. A portion of the return panel is biased against a portion of the main panel so as to retain an in-store marketing sign in a pocket that is defined by the main panel, the first bend and the return panel. The return panel includes at least one mounting portion that is oriented out-of-plane from a remaining portion of the return panel by at least one second bend and extends from the at least one second bend to at least one distal end. Each distal end of each mounting portion is a part of the free end of the return panel.

A method of altering a display fixture includes inserting the at least one protruding member of a sign holder into a through slot in a shelf of a display fixture. The method further includes engaging the at least one hook portion of the at least one protruding member with a bottom edge of a protrusion that downwardly extends from a bottom surface of the shelf to hold the sign holder in place.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

In a business, such as a retail business, certain areas in a store, such as an electronics area, display models of products on display stands that are located on shelf-type display structures. Oftentimes the models on display include power cords and wires to keep the model operational and security lanyards to prevent theft. The display stands that the models are mounted to create a clutter-free and uniform looking presentation so that a customer can hold and test the models. In some instances, the display stands are mounted to openings or slots in a shelf-type display structure to further organize the cords, wires and lanyards underneath the shelf.

Sign holders receive in-store marketing signs including printed material indicating information about the model on display and the product price of that model. Such sign holders need to integrate with the shelf-type display structures and the display stands that hold the models of the products in a way that is not obstructive, but still identifies the model it is describing.

As will be described in detail below, a sign holder engages with a shelf-type or table top display structure through a slot or opening in the display structure. The engagement of the sign holder with the display structure modifies or alters the display structure so that the model of a product being offered for sale is displayed with information of interest to a customer including the product price. The sign holder includes a sign sleeve for receiving a sheet of printed material and at least one protruding member that is coupled to a back of the sign sleeve. The protruding member includes a leg portion and a hook portion. The protruding member engages with the underside of the shelf-type or table top display structure through an opening or slot in the shelf-type display structure. When the sign holder is mounted to the shelf-type display structure, the sign sleeve is substantially parallel with and flush against a top surface of the shelf-type display structure and is positioned so that the printed material in the sign sleeve is shown below and in close proximity to the model being held by a display stand that is located in the same opening or another opening or slot in the display structure.

Figure 1:
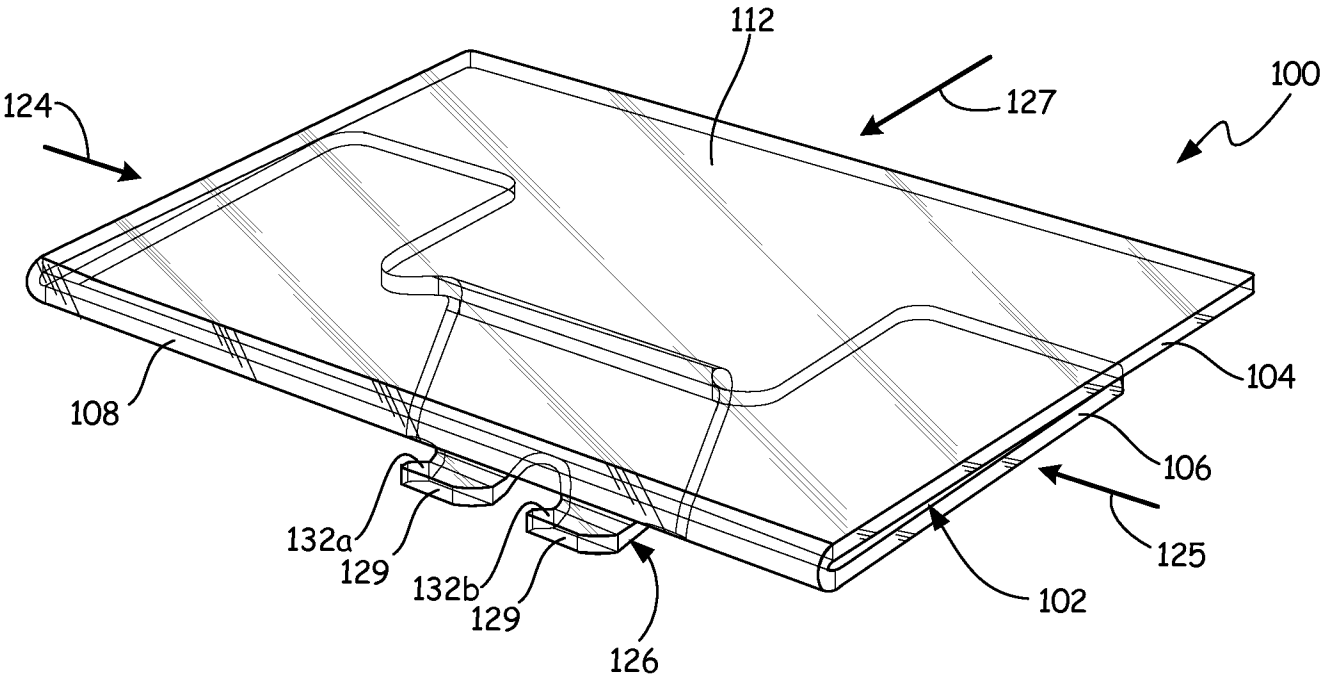
FIG. 1 is a perspective view of a sign holder according to one embodiment.
Figure 2:
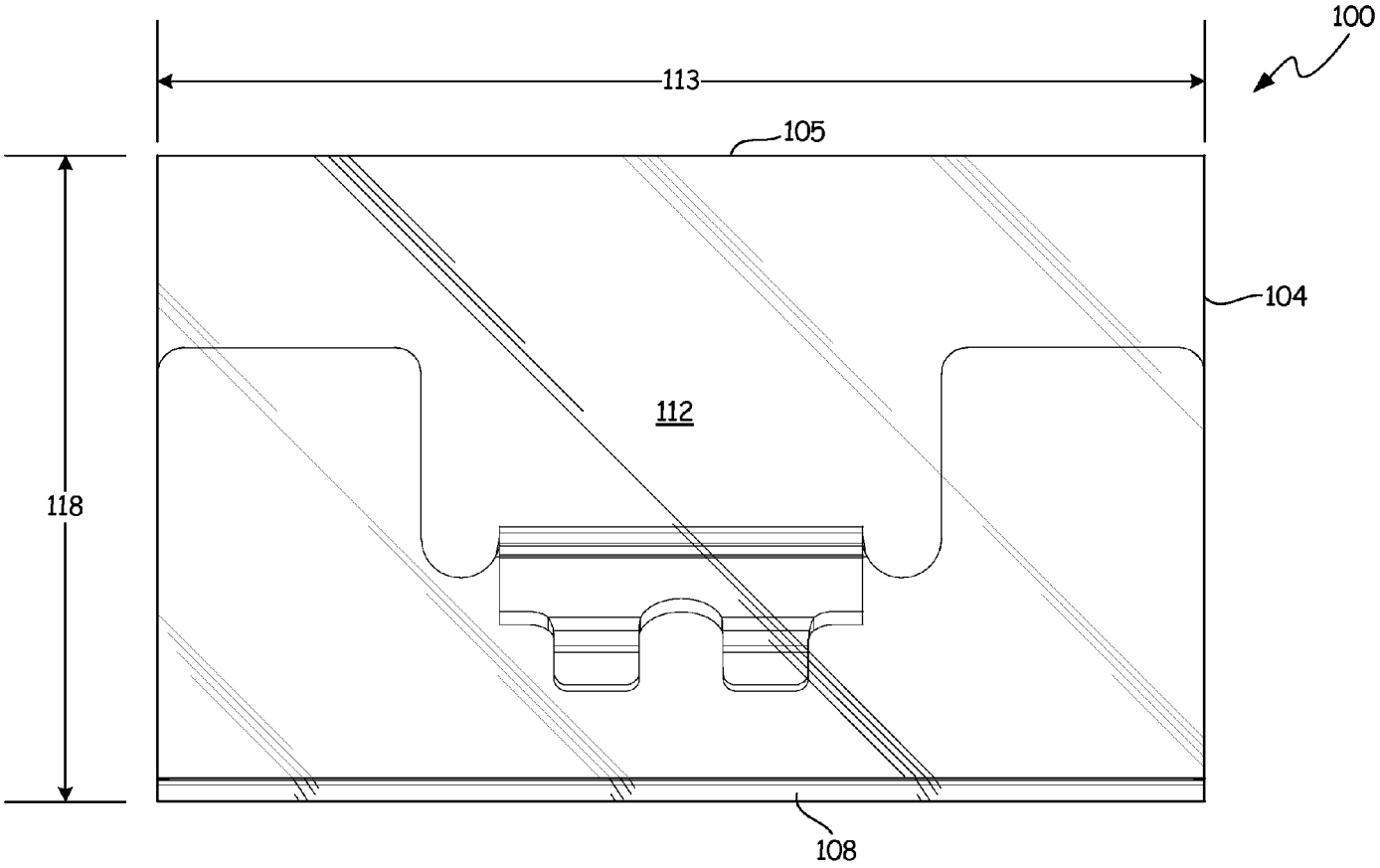
FIG. 2 is a top view of the sign holder illustrated in FIG. 1.
Figure 7:
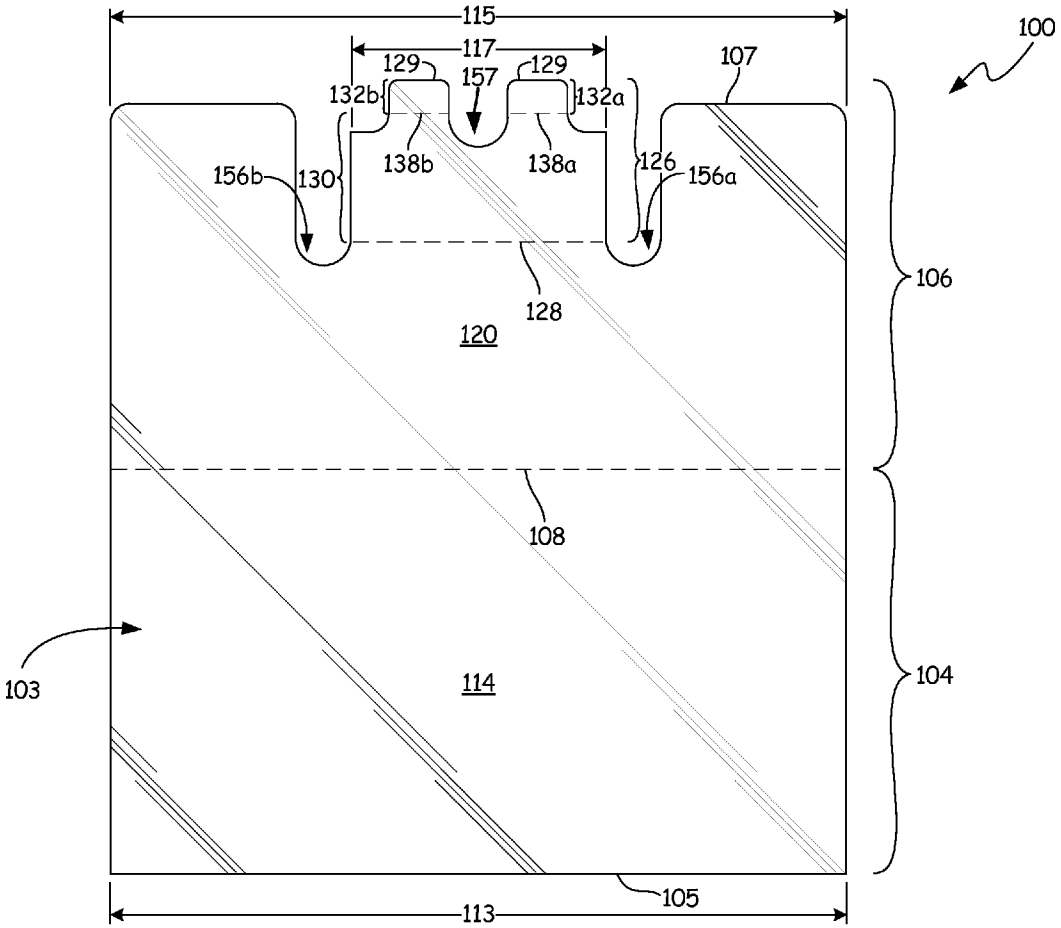
FIG. 7 is a plan view of the sign holder illustrated in FIG. 1 in an unfolded state.

FIG. 1 is a perspective view of a sign holder 100 according to one embodiment. A top view, a bottom view, a right side view (a left side view being a mirror image), a front view and a back view are illustrated in FIGS. 2-6. In one embodiment, sign holder 100 is integrally formed and made of a single, continuous piece of folded sheet material like a polymer or plastic. For example, FIG. 7 illustrates a plan view of sign holder 100 as a single, continuous piece of sheet material in an unfolded state. The broken lines in FIG. 7 are indicative of the locations of bend lines. In another embodiment, sign holder 100 is integrally formed and made by extruding a material like a polymer or plastic. For example, sign holder 100 can be made of a single, continuous piece of extruded clear polyethylene terephthalate glycol (PETG). Either way, sign holder 100 includes a sign sleeve or pocket 102 for receiving a sheet of printed medium.

Sign sleeve or pocket 102 is defined by a main panel or viewing flange 104, a return panel or base flange 106, and a first joint 108 that couples or fixes main panel 104 to return panel 106. At least main panel or viewing flange 104 is made of a transparent polymer or plastic such that a sheet of printed medium that is received by sign sleeve 102 can be clearly viewed. In the illustrated embodiment, however, main panel 104, return panel 106 and first joint 108 are all made of a transparent polymer or plastic. Main panel 104 extends substantially planar from first joint 108 to a free end 105 and includes an exterior facing or first surface 112, an interior facing or second surface 114 opposite first surface 112 and a width 113. Return panel 106 extends substantially planar from first joint 108 to a free end 107 and includes an interior facing surface or first surface 120, an exterior facing surface or second surface 122 opposite first surface 120 and a width 115. In the embodiments illustrated in FIGS. 1-7, width 113 is substantially equal to width 115. Free end 107 terminates along main panel 104 at a dimension 116 (FIG. 3) from first joint 108 that is less than a dimension 118 (FIG. 2) of free end 105 of main panel 104 from first joint 108.

In one embodiment, while return panel 106 extends substantially planar from first joint 108, return panel 106 is not substantially parallel with main panel 104. Rather, a portion of return panel 106 is biased against a portion of main panel 104 so as to retain an in-store marketing sign 101 (FIG. 9) in sign sleeve or pocket 102. In other words, a portion of interior facing surface 120 of return panel is biased against a portion of interior facing surface 114 of main panel 104 so as to hold a sign 101 in sign sleeve 102. Sign 101 can be inserted between main panel 104 and return panel 106 from either side of sign holder 100 as indicated by arrow 124 (FIG. 1) and arrow 125 (FIG. 1) or inserted top-down as illustrated by arrow 127 (FIG. 1). In one embodiment, the sign, such as sign 101, that is placed in sign sleeve 102 can be a thin gauge printable sheet material, such as paper, cardstock, paper board, etc., that is printed with textual and/or graphical indicia. The graphical indicia can include generalized information relating to an item or model being displayed on the display structure to which sign holder 100 is attached, such as indicia indicative of brand identification, graphical design, price and the like.

In the embodiment where sign holder 100 is a single, continuous piece of folded sheet material, the sheet material includes a first surface 103 and an opposing second surface (not illustrated in FIG. 7). In other words, interior facing surfaces 114 and 120 of main panel 104 and return panel 106, respectively, are parts of first surface 103 of the sheet material and exterior facing surfaces 112 and 122 of main panel 104 and return panel 106, respectively, are part of the opposing second surface of the sheet material. In addition, first joint 108 that couples main panel 104 to return panel 106 is a first bend 108. In this embodiment, a portion of first surface 103 of the sheet material that is located along return panel 106 is biased against a different portion of first surface 103 of the sheet material that is located along main panel 104 so as to hold sign 101.

With reference back to FIGS. 1-6 and regardless of whether sign holder 100 is a folded, continuous sheet of material or is extruded, sign holder 100 also includes at least one mounting portion or at least one protruding member 126 that is coupled to return panel 106 by a second joint 128 and oriented out-of-plane from return panel 106. The at least one protruding member 126 is configured to engage with a portion of a display fixture so as to secure sign holder 100 to the display fixture. Each protruding member 126 includes a first surface 140, an opposing second surface 142 and a width 117. Width 117 of each protruding member 126 is less than width 113 of main panel 104 and width 115 of return panel 106. Each protruding member 126 also includes a leg or leg portion 130, at least one third joint 138 (i.e., 138*a* and 138*b*), at least one prong or hook portion 132 (i.e., 132*a* and 132*b*) and a distal end 129. Leg 130 is defined between second joint 128 and the at least one third joint 138*a* and 138*b* and the at least one prong 132*a* and 132*b* is defined between the at least one third joint 138*a* and 138*b* and distal end 129. Second joint 128 orients each protruding member 126 downwards from return panel 106 so that first surface 140 of each protruding member 126 along leg 130 is oriented at an angle 144 relative to second surface 122 of return panel 106 that is greater than 0 degrees and less than 180 degrees. In one embodiment, angle 144 is an acute angle that is substantially equal to about 52 degrees. Likewise, second surface 142 of each protruding member 126 along leg 130 is oriented at an angle 145 relative to second surface 122 of return panel 106 that is greater than 0 degrees and less than 180 degrees. In one embodiment, angle 145 is an obtuse angle that is substantially equal to about 128 degrees As shown in the embodiment illustrated in FIGS. 1-7, prong portion 132 includes two prongs 132*a* and 132*b*. However, it is possible that more or fewer prongs than prongs 132*a* and 132*b* can be joined to leg 130 at a third joint. Each third joint 138*a* and 138*b* orients each prong 132*a* and 132*b* upwards from leg 130 so that first surface 140 along each prong 132*a* and 132*b* is oriented at an angle 152 relative first surface 140 along leg 130 that is greater than 0 degrees and less than 180 degrees. In one embodiment, angle 152 is an obtuse angle that is substantially equal to about 105 degrees. Likewise, second surface 142 along each prong 132*a* and 132*b* is oriented at an angle 154 relative to a plane containing second surface 142 along leg 130 that is greater than 0 degrees and less than 180 degrees.

In one embodiment, angle 154 is an acute angle that substantially equal to about 75 degrees.

In the embodiment where sign holder 100 is a single, continuous piece of folded sheet material as illustrated in FIG. 7, return panel 106 includes at least one mounting portion 126. At least one mounting portion 126 is oriented out-of-plane from and folded under a remaining portion of return panel 106 at second joint 128, which is a second bend 128 in this embodiment, and the at least one third joint 138*a* and 138*b* that couples leg 130 to the at least one prong 132*a* and 132*b* is an at least one third bend 138*a* and 138*b*. Therefore, distal end 129 of at least one mounting portion 126 comprises a portion of free end 107 of return panel 106. In other words, distal end 129 of each mounting portion 126 is continuous with free end 107 of return panel 106. Still further, first surface 103 of the sheet material located along leg 130 of each mounting portion 126 is oriented at an acute angle 144 from first surface 103 located along a remaining portion of return panel 106 and first surface 103 of the sheet material located along each prong 132*a* and 132*b* of each mounting portion 126 is oriented at an obtuse angle 152 from first surface 103 of the sheet material located along leg 130 of each mounting portion 126.

Figure 3:
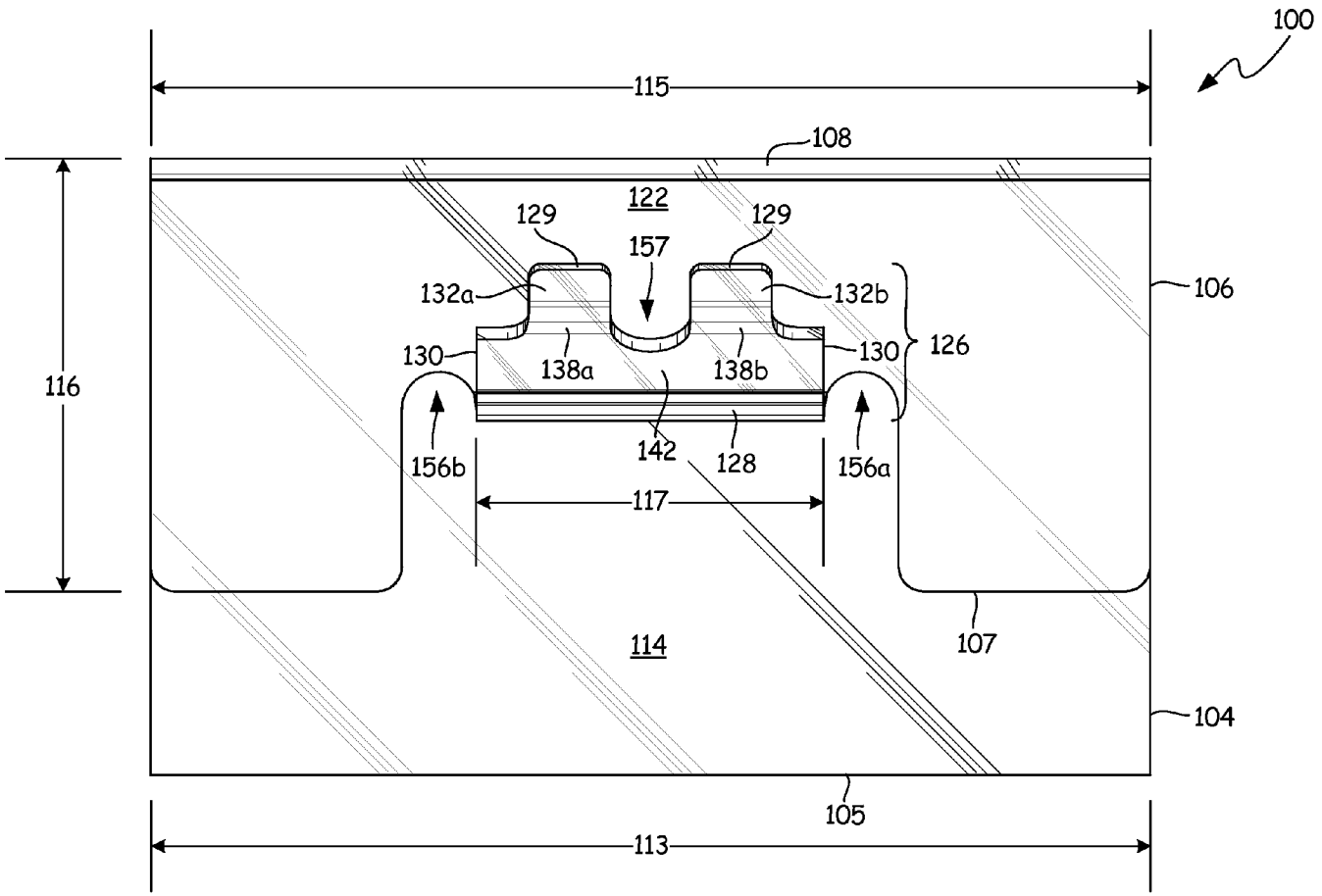
FIG. 3 is a back view of the sign holder illustrated in FIG. 1.
Figure 4:
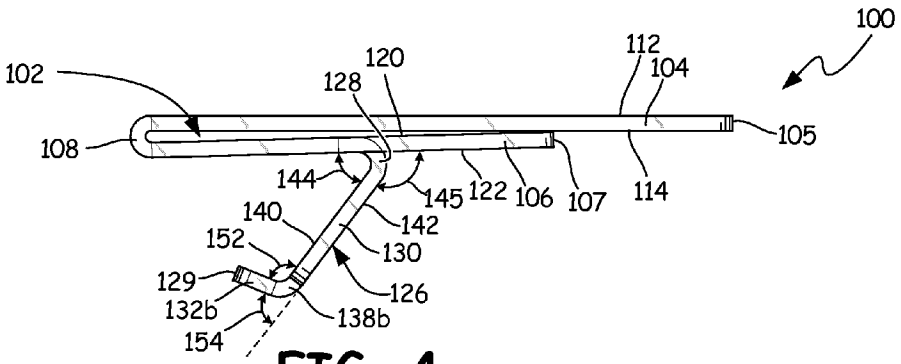
FIG. 4 is a right side view of the sign holder illustrated in FIG. 1.
Figure 5:
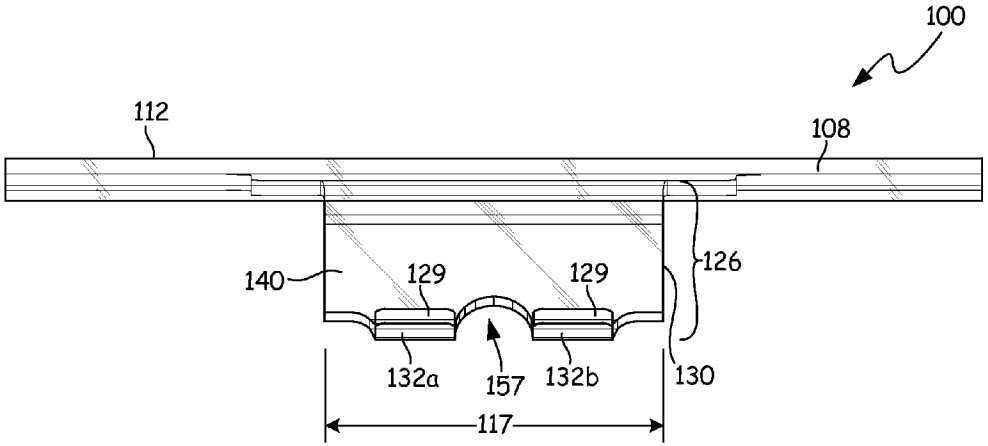
FIG. 5 is a front view of the sign holder illustrated in FIG. 1.
Figure 6:
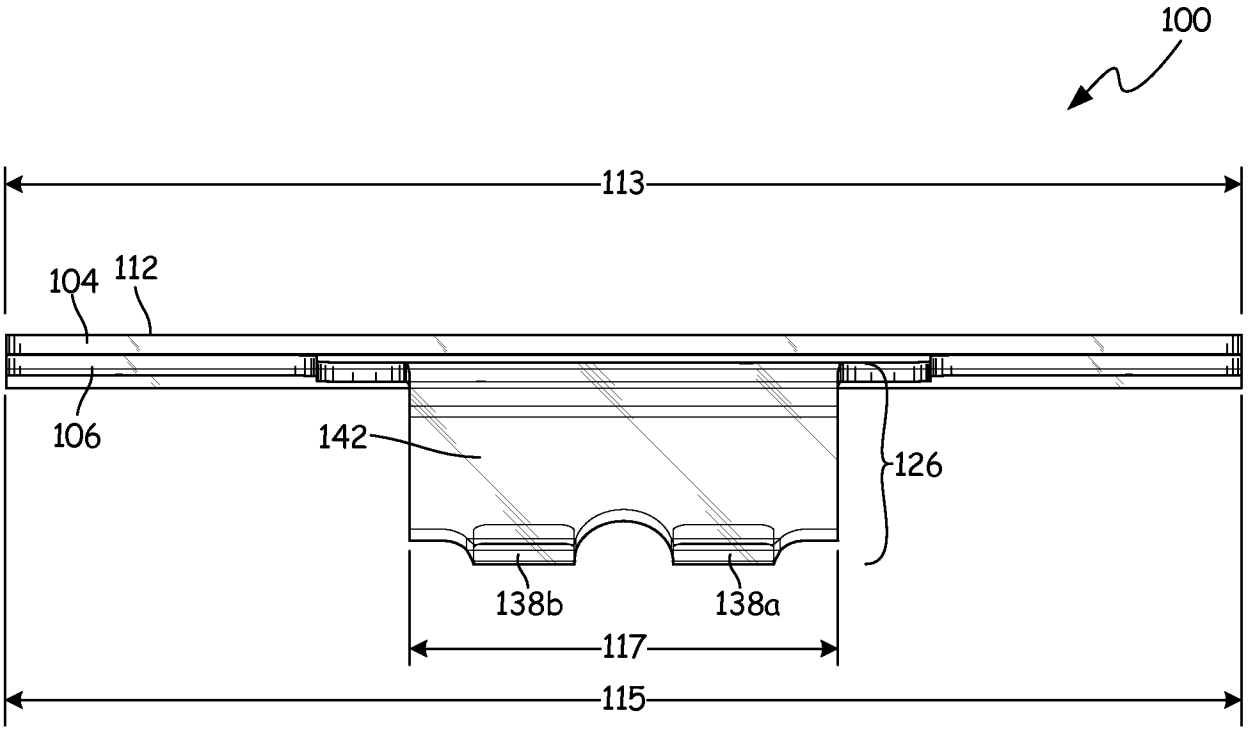
FIG. 6 is back view of the sign holder illustrated in FIG. 1.

As best illustrated in FIGS. 3 and 7 and in one embodiment, edges of return panel 106 join with edges of the at least one protruding member 126. More specifically, edges of return panel 106 intersect with edges of the at least one protruding member 126 at rounded corners or curves 156*a* and 156*b*. Rounded corners 156*a* and 156*b* provide structural integrity to joint or bend 128. In addition, leg 130 includes a rounded or curved edge 157 located between and joined with edges of prongs 132*a* and 132*b*. Rounded corner or curved edge 157 is shaped to engage with or receive a position key or nub on a protrusion that downwardly extends from a bottom of a shelf of a shelf-type display. This engagement provides a snap fit between sign holder 100 and the shelf-type display fixture, which will be further described below.

Figure 8:
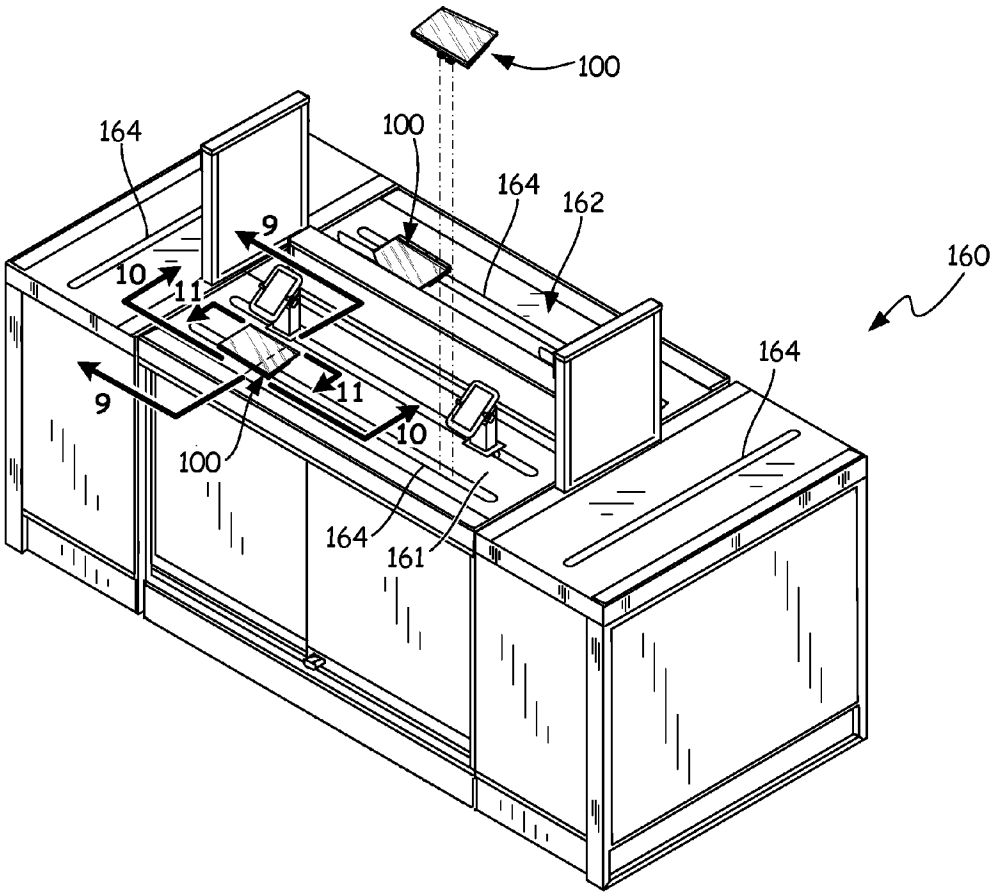
FIG. 8 is a perspective view of a display apparatus to which the sign holder illustrated in FIG. 1 can be attached.
Figure 9:
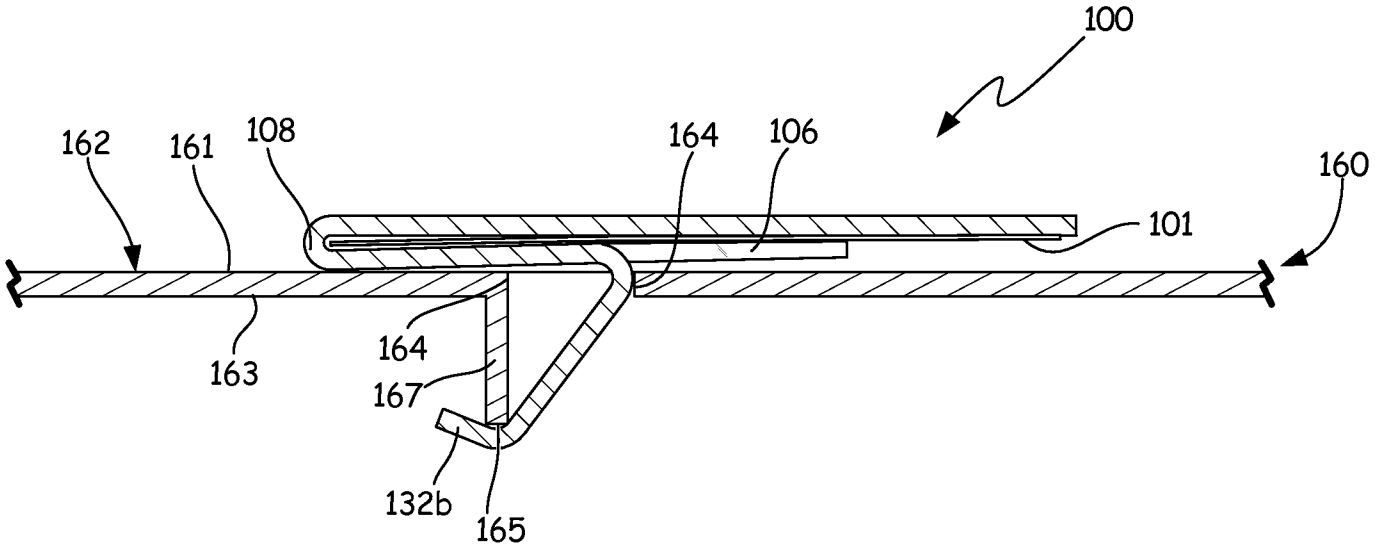
FIG. 9 is an enlarged section view of the sign holder and display apparatus taken through the line indicated in FIG. 8.
Figure 10:
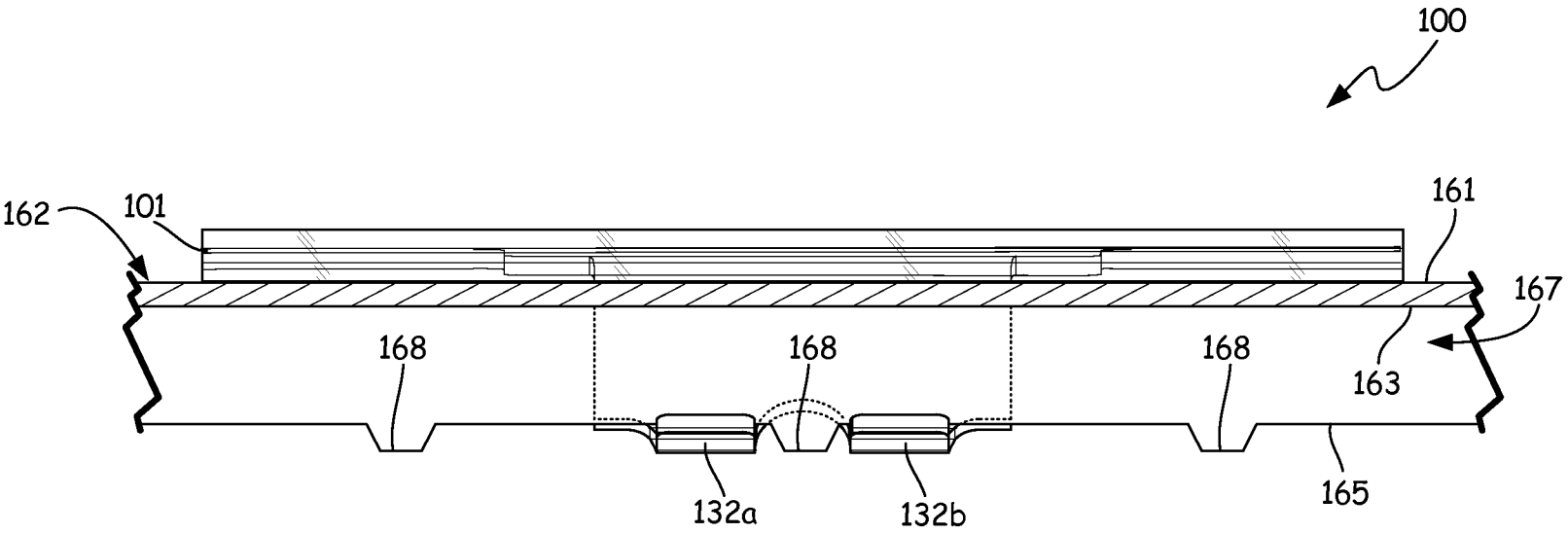
FIG. 10 is an enlarged section view of the sign holder and display apparatus taken through the line indicated in FIG. 8.
Figure 11:
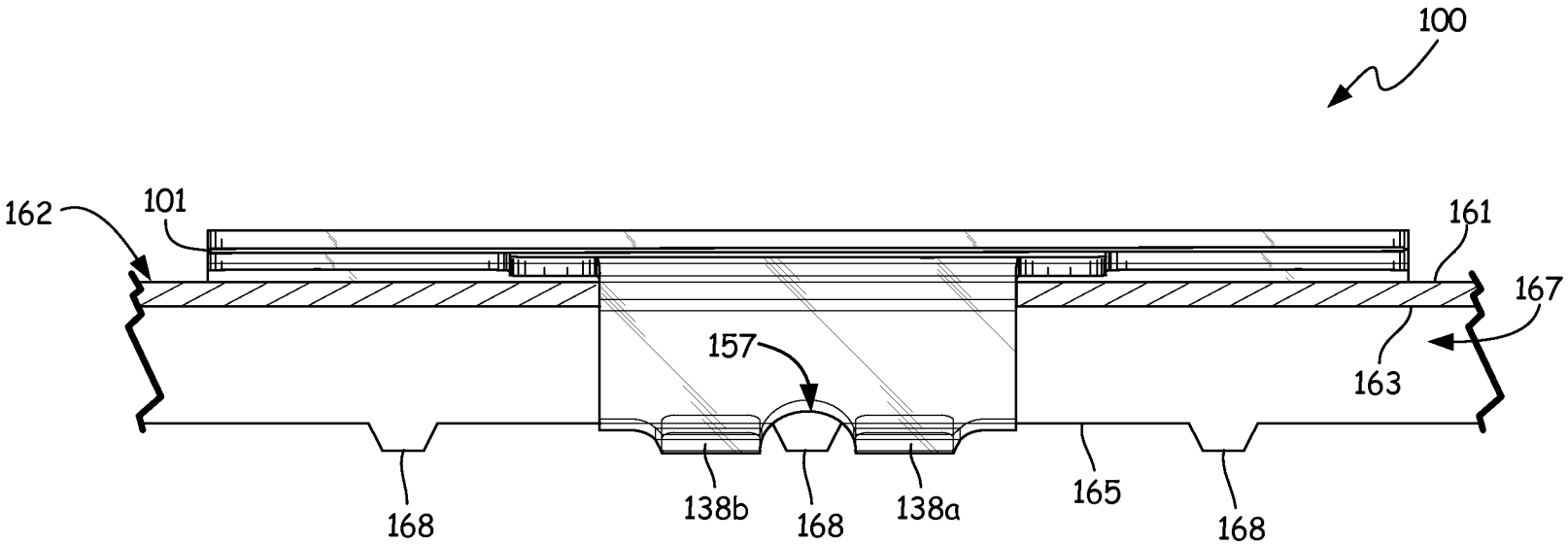
FIG. 11 is an enlarged section view of the sign holder and display apparatus taken through the line indicated in FIG. 8.

FIG. 8 illustrates a perspective view of an exemplary shelf-type display fixture 160 to which sign holders 100 can be attached for display. Display fixture 160 includes at least one table top or shelf 162 having a top surface 161. Table top or shelf 162 includes at least one slot 164 that extends therethrough (i.e., extends between top surface 161 and a bottom surface 163 of shelf 162 as illustrated in FIG. 9). Each sign holder 100 attaches to display fixture 160 by inserting at least one protruding member or at least one mounting portion 126 of sign holder 100 into one of the slots 164 until it snaps into a secured position. FIGS. 9-11 are sectional views of sign holder 100 and table top or shelf 162 taken through the lines indicated in FIG. 8 according to one embodiment. As illustrated in FIGS. 9-11, prongs 132*a* and 132*b* of protruding member or mounting portion 126 (of which prong 132*a* is hidden from view in FIG. 9) engage with a bottom edge 165 of a protrusion 167. Each slot 164 includes an associated protrusion 167 that downwardly extends from bottom surface 163 of table top or shelf 162 and laterally extends along each slot 164. Still further, bottom edge 165 of each protrusion includes a plurality of spaced apart nubs or position keys 168. As illustrated in FIGS. 9-11, prongs 132*a* and 132*b*, which are coupled to leg 130 by joints 138*a* and 138*b*, straddle a nub or position key 168 so that curved edge 157 of leg 130 engages with the nub or position key as well as prongs 132*a* and 132*b* being positioned to curl around bottom edge 165. This snap-fit engagement prevents sign holder 100 from laterally sliding along slot 164 and prevents sign holder 100 from being rotated within slot 164. It should be realized that prongs 132*a* and 132*b* as well as curved edge 157 can be used in other ways to secure sign holder 100 to shelf-type display fixture 160. To remove sign holder 100, access to underneath shelf or table top 162 will have to be gained so as to manually release prongs 132*a* and 132*b* from bottom edge 165 by pulling down on prongs 132*a* and 132*b*.

Figure 12:
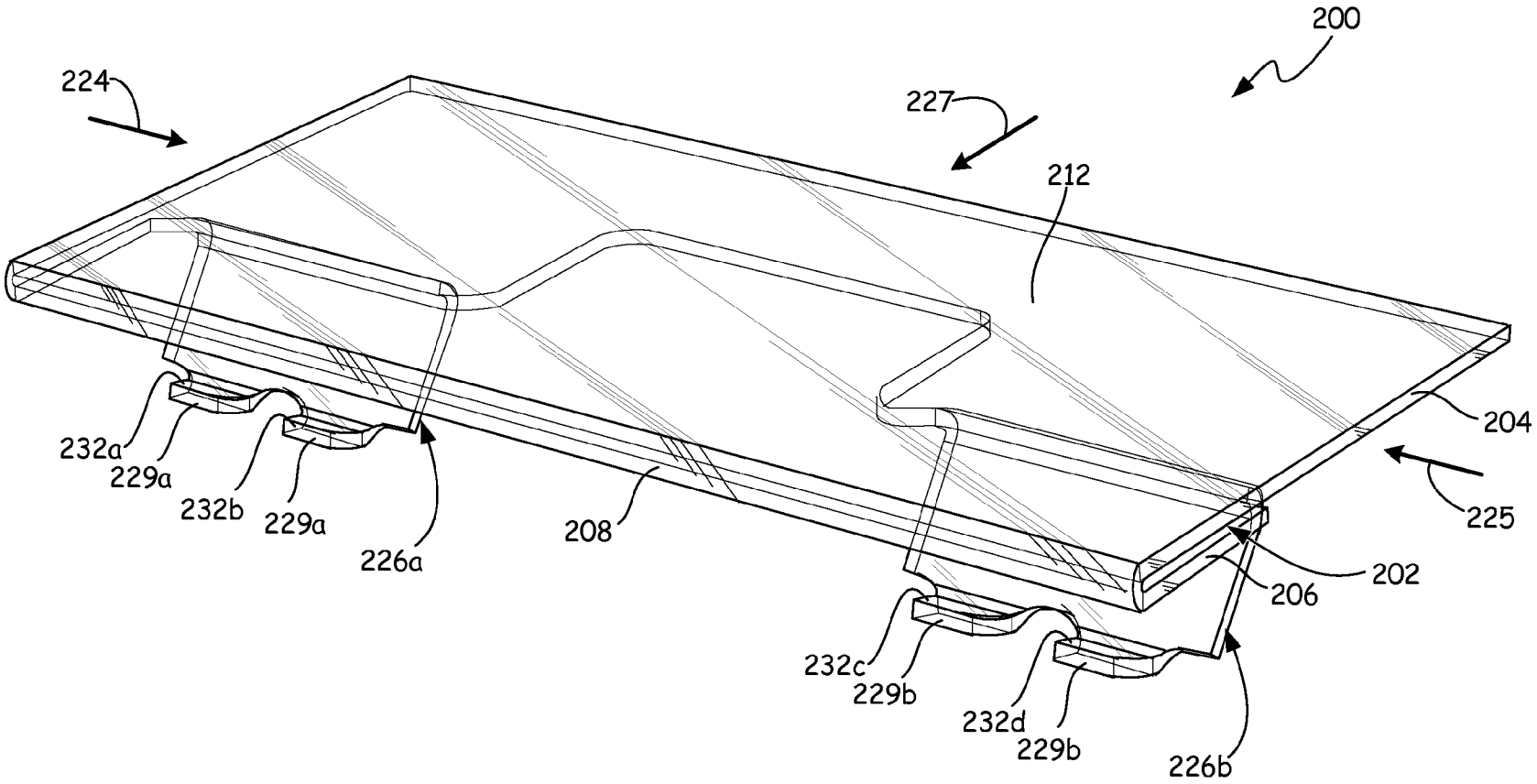
FIG. 12 is a perspective view of a sign holder according to another embodiment.
Figure 13:
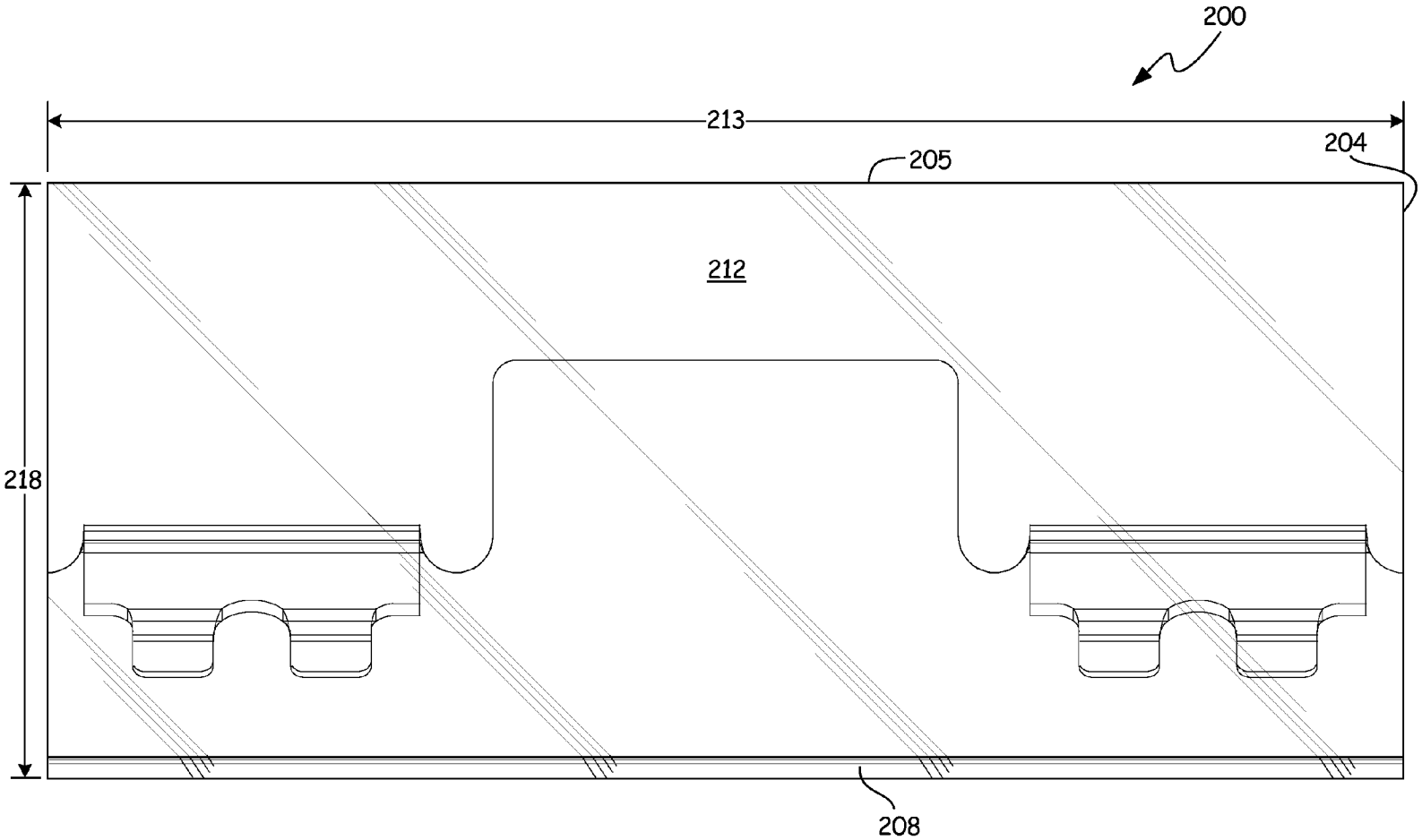
FIG. 13 is a top view of the sign holder illustrated in FIG. 12.
Figure 18:
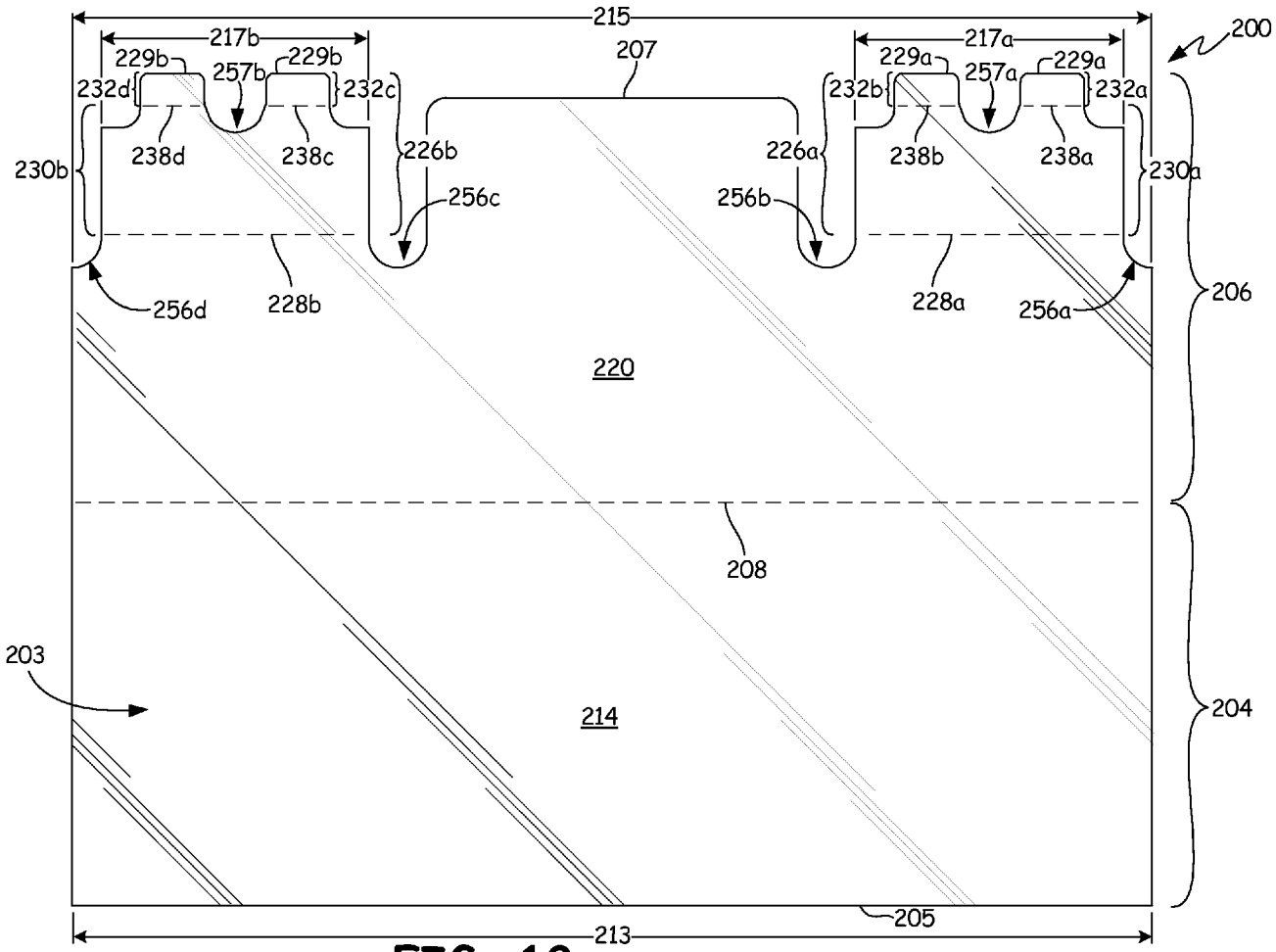
FIG. 18 is a plan view of the sign holder illustrated in FIG. 12 in an unfolded state.

FIG. 12 is a perspective view of a sign holder 200 according to another embodiment. A top view, a bottom view, a right side view (a left side view being a mirror image), a front view and a back view are illustrated in FIGS. 13-17. In one embodiment, sign holder 200 is integrally formed and made of a single, continuous piece of folded sheet material like a polymer or plastic. For example, FIG. 18 illustrates a plan view of sign holder 200 as a single, continuous piece of sheet material in an unfolded state. The broken lines in FIG. 18 are indicative of the locations of bend lines. In another embodiment, sign holder 200 is integrally formed and made by extruding a material like a polymer or plastic. For example, sign holder 200 can be made of a single, continuous piece of extruded clear polyethylene terephthalate glycol (PETG). Either way, sign holder 200 includes a sign sleeve or pocket 202 for receiving a sheet of printed medium.

Sign sleeve or pocket 202 is defined by a main panel or viewing flange 204, a return panel or base flange 206, and a first joint 208 that couples or fixes main panel 204 to return panel 206. At least main panel or viewing flange 204 is made of a transparent polymer or plastic such that the sheet of printed medium that is received by sign sleeve 202 can be clearly viewed. In the illustrated embodiment, however, main panel 204, return panel 206 and first joint 208 are all made of a transparent polymer or plastic. Main panel 204 extends substantially planar from first joint 208 to a free end 205 and includes an exterior facing or first surface 212, an interior facing or second surface 214 opposite first surface 212 and a width 213. Return panel 206 extends substantially planar from first bend 208 to a free end 207 and includes an interior facing surface or first surface 220, an exterior facing surface or second surface 222 opposite first surface 220 and a width 215. As illustrated in the embodiments in FIGS. 12-17, width 213 is substantially equal to width 215. Free end 207 terminates along main panel 204 at a dimension 216 (FIG. 14) from first joint 208 that is less than a dimension 218 (FIG. 13) of free end 205 of main panel 204 from first joint 208.

In one embodiment, while return panel 206 extends substantially planar from first bend 208, return panel 206 is not substantially parallel with main panel 204. Rather, a portion of return panel 206 is biased against a portion of main panel 204 so as to retain an in-store marketing sign 201 (FIG. 20) in sign sleeve or pocket 202. In other words, a portion of interior facing surface 220 of return panel is biased against a portion of interior facing surface 214 of main panel 204 so as to hold a sign 201 in sign sleeve 202. Sign 201 can be inserted between main panel 204 and return panel 206 from either side of sign holder 200 as indicated by arrow 224 (FIG. 12) and arrow 225 (FIG. 12) or inserted top-down as illustrated by arrow 227 (FIG. 12). In one embodiment, the sign, such as sign 201, placed in sign sleeve 202 can be a thin gauge printable sheet material, such as paper, cardstock, paper board, etc., that is printed with textual and/or graphical indicia. The graphical indicia can include generalized information relating to an item or model being displayed on the display structure to which sign holder 200 is attached, such as indicia indicative of brand identification, graphical design, price and the like.

In the embodiment where sign holder 200 is a single, continuous piece of folded sheet material, the sheet material includes a first surface 203 and an opposing second surface (not illustrated in FIG. 18). In other words, interior facing surfaces 214 and 220 of main panel 204 and return panel 206, respectively, are parts of first surface 203 of the sheet material and exterior facing surfaces 212 and 222 of main panel 204 and return panel 206, respectively, are part of the opposing second surface of the sheet material. In addition, joint 208 that couples main panel 204 to return panel 206 is a first bend 208. In this embodiment, a portion of first surface 203 of the sheet material that is located along return panel 206 is biased against a different portion of first surface 203 of the sheet material that is located along main panel 204 so as to hold sign 201.

With reference back to FIGS. 12-17, sign holder 200 also includes at least two mounting portions or at least two protruding members 226*a* and 226*b* that are coupled to return panel 206 by second joints 228*a* and 228, oriented out-of-plane from return panel 206 and are spaced apart from each other. The at least two protruding members 226*a* and 226*b* are configured to engage with a portion of a display fixture so as to secure sign holder 200 to the display fixture. Each protruding member 226*a* and 226*b* includes a first surface 240*a* and 240*b*, an opposing second surface 242*a* and 242*b* and a width 217*a* and 217*b*. Widths 217*a* and 217*b* of each protruding member 226*a* and 226*b* are less than width 213 of main panel 204 and width 215 of return panel 206. Each protruding member 226*a* and 226*b* also includes a leg or leg portion 230*a* and 230*b*, at least one third joint 238 (i.e., 238*a*, 238*b*, 238*c* and 238*d*), at least one prong or hook portion 232 (i.e., 232*a*, 232*b*, 232*c* and 232*d*) and a distal end 229*a* and 229*b*. Leg 230*a* is defined between second joint 228*a* and the at least one third joint 238*a* and 238*b* and the at least one prong 232*a* and 232*b* is defined between the at least one third joint 238*a* and 238*b* and distal end 229*a*. Leg 230*b* is defined between second joint 228*b* and the at least one third joint 238*c* and 238*d* and the at least one prong 232*c* and 232*d* is defined between the at least one third joint 238*c* and 238*d* and distal end 229*b*. Second joints 228*a* and 228*b* orient each protruding member 226*a* and 226*b* downwards from return panel 206 so that first surface 240*a* and 240*b* of each protruding member 226*a* and 226*b* along leg 230*a* and 230*b* is oriented at an angle 244 relative to second surface 222 of return panel 206 that is greater than 0 degrees and less than 180 degrees. In one embodiment, angle 244 is an acute angle that is substantially equal to about 52 degrees. Likewise, second surface 242*a* and 242*b* of each protruding member 226*a* and 226*b* along leg 230*a* and 230*b* is oriented at an angle 245 relative to second surface 222 of return panel 206 that is greater than 0 degrees and less than 180 degrees. In one embodiment, angle 245 is an obtuse angle that is substantially equal to about 128 degrees As shown in the embodiment illustrated in FIGS. 12-18, each protruding member 226*a* and 226*b* includes two prongs 232*a* and 232*b* or prongs 232*c* and 232*d*. However, it is possible that more or fewer prongs than prongs 232*a*, 232*b*, 232*c* and 232*d* can be joined to leg 230*a* and leg 230*b* at a third joint. Each third joint 238*a*, 238*b*, 238*c* and 238*d* orients each prong 232*a*, 232*b*, 232*c* and 232*d* upwards from each leg 230*a* and 230*b* so that first surface 240*a* and 240*b* along each prong 232*a-d* is oriented at an angle 252 relative to first surface 240*a* and 240*b* along each leg 230*a* and 230*b* that is greater than 0 degrees and less than 180 degrees. In one embodiment, angle 252 is an obtuse angle that is substantially equal to about 105 degrees. Likewise, each second surface 242*a* and 242*b* along each prong 232*a* and 232*b* is oriented at an angle 254 relative to a plane containing second surface 242*a* or 242*b* along leg 230*a* or 230*b* that is greater than 0 degrees and less than 180 degrees. In one embodiment, angle 254 is an acute angle that is substantially equal to about 75 degrees.

In the embodiment where sign holder 200 is a single, continuous piece of folded sheet material as illustrated in FIG. 18, return panel 206 includes at least one mounting portion 226*a* and 226*b*. Each mounting portion 226*a* and 226*b* is oriented out-of-plane from and folded under a remaining portion of return panel 206 at second joints 228*a* and 228*b*, which are second bends 228*a* and 228*b* in this embodiment. Third joints 238*a*, 238*b*, 238*c* and 238*d* that couple legs 230*a* and 230*b* to the at least one prong 232*a*, 232*b*, 232*c* and 232*d* are third bends 238*a*, 238*b*, 238*c* and 238*d*. Therefore, distal ends 229*a* and 229*b* of mounting portions 226*a* and 226*b* comprise a portion of free end 207 of return panel 206. In other words, distal ends 229*a* and 229*b* of mounting portions 226*a* and 226*b* are continuous with free end 207 of return panel 206. Still further, first surface 203 of the sheet material located along legs 230*a* and 230*b* of each mounting portion 226*a* and 226*b* is oriented at an acute angle 244 from first surface 203 of the sheet material that is located along a remaining portion of return panel 206, and first surface 203 of the sheet material, which is located along each prong 232*a-d* of each mounting portion 226*a* and 226*b*, is oriented at an obtuse angle 252 from first surface 203 of the sheet material that is located along legs 230*a* and 230*b* of each mounting portion 226*a* and 226*b*.

Figure 14:
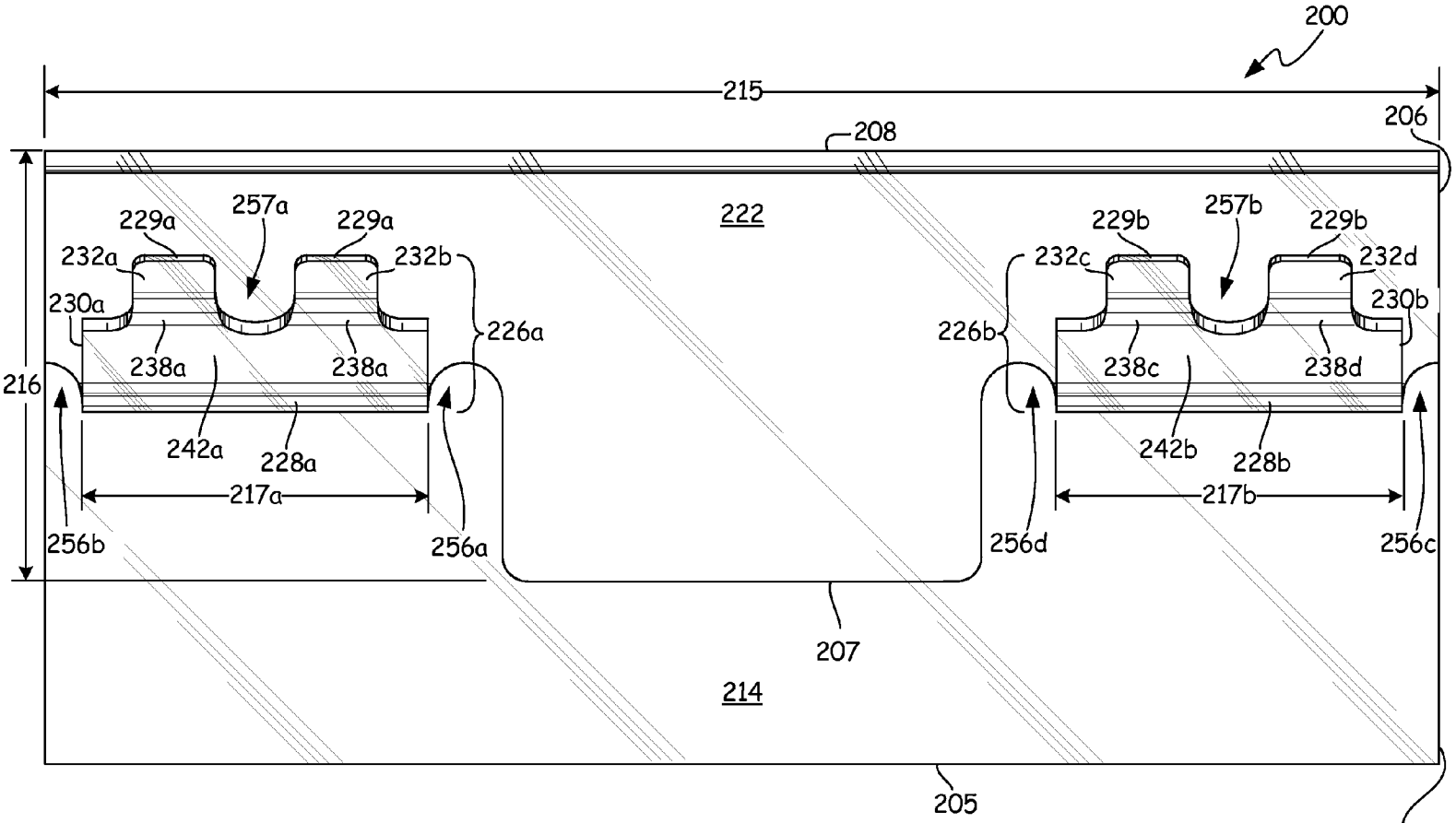
FIG. 14 is a back view of the sign holder illustrated in FIG. 12.
Figure 15:
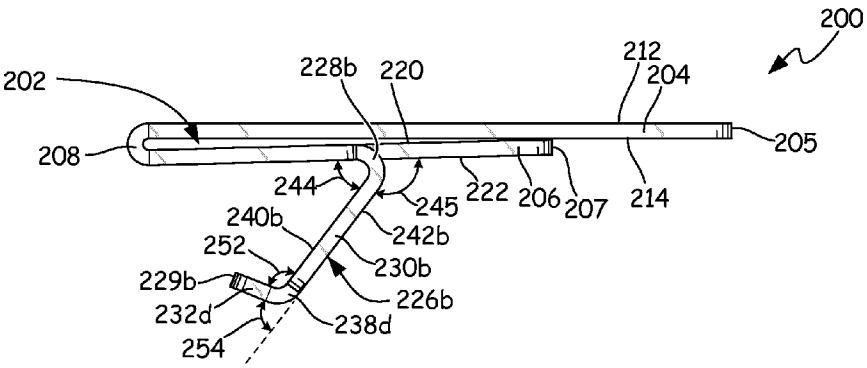
FIG. 15 is a right side view of the sign holder illustrated in FIG. 12.
Figure 16:
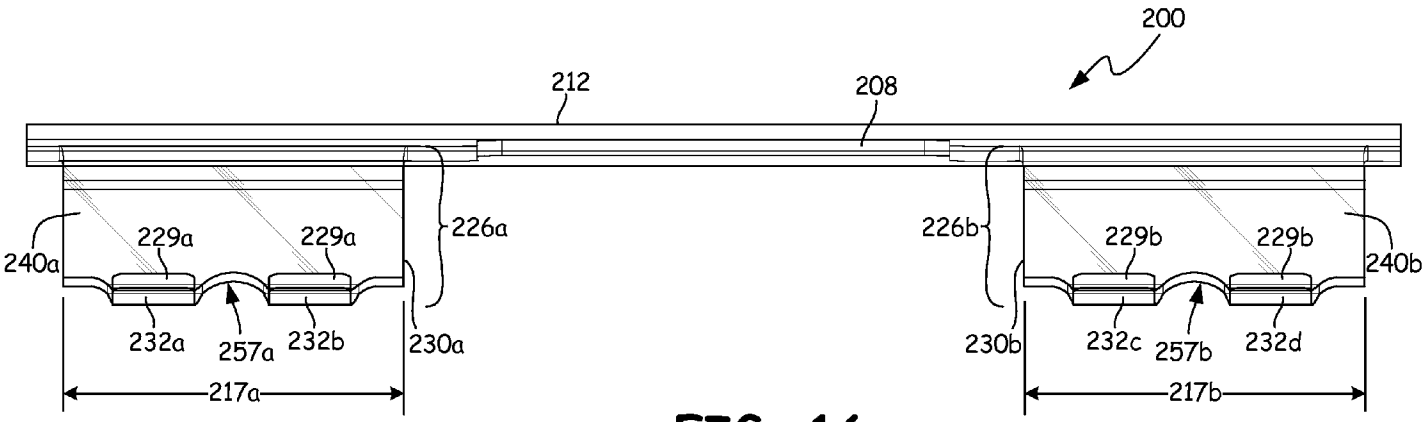
FIG. 16 is a front view of the sign holder illustrated in FIG. 12.
Figure 17:
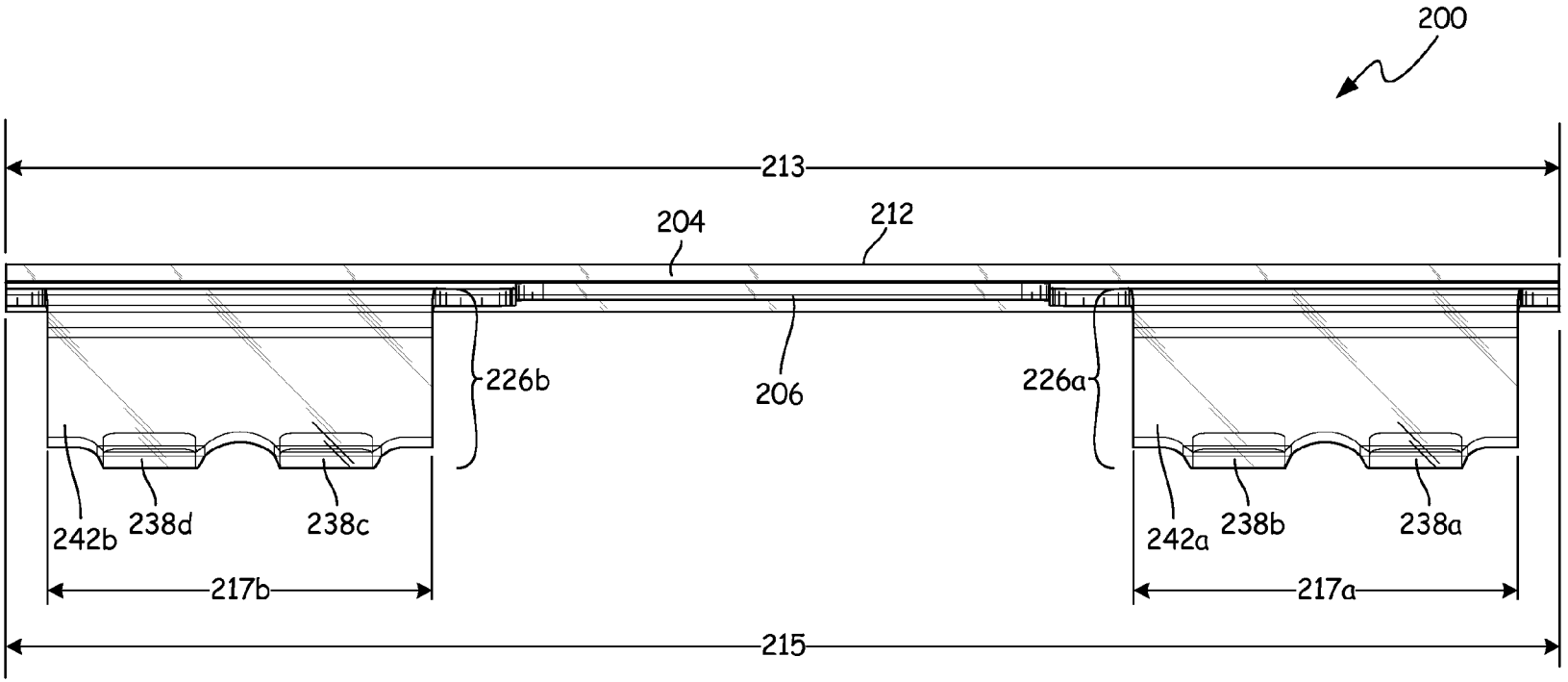
FIG. 17 is back view of the sign holder illustrated in FIG. 12.

As best illustrated in FIGS. 14 and 18 and in one embodiment, edges of return panel 206 are joined with edges of protruding members 226*a* and 226*b*. More specifically, edges of return panel 206 are joined with edges of the at least one protruding members 226*a* and 226*b* by rounded corners or curves 256*a*, 256*b*, 256*c* and 256*d*. Rounded corners 256*a-d* provide structural integrity to joints or bends 228*a* and 228*b*. In addition, each leg 230*a* and 230*b* includes a rounded or curved edge 257*a* or 257*b* located between and intersecting with edges of prongs 232*a* and 232*b* or 232*c* and 232*d*. Rounded corner or curved edge 257*a* or 257*b* are each shaped to engage with or receive a position key or nub on a protrusion that downwardly extends from a bottom of a shelf of a shelf-type display. This engagement provides a snap fit between sign holder 200 and the shelf-type display fixture, which will be further described below.

Figure 19:
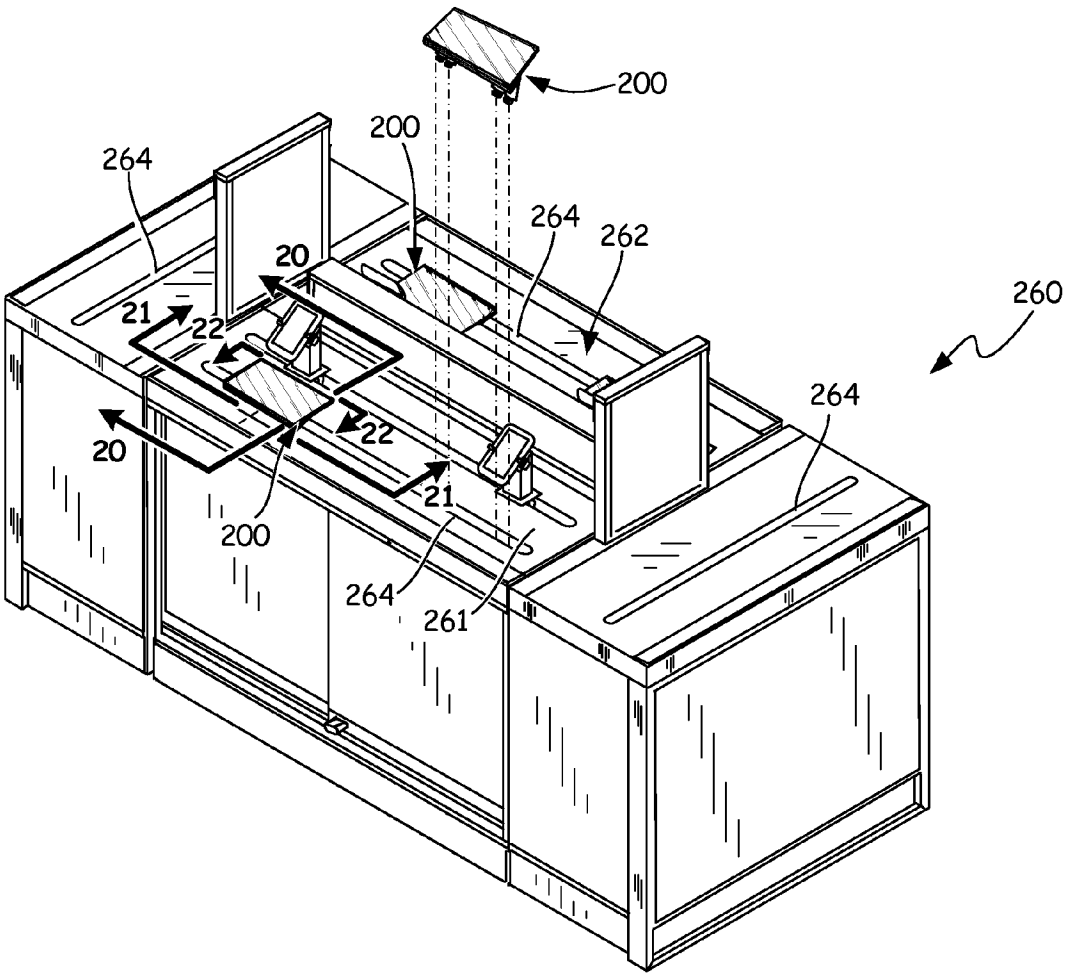
FIG. 19 is a perspective view of a display apparatus to which the sign holder illustrated in FIG. 12 can be attached.
Figure 20:
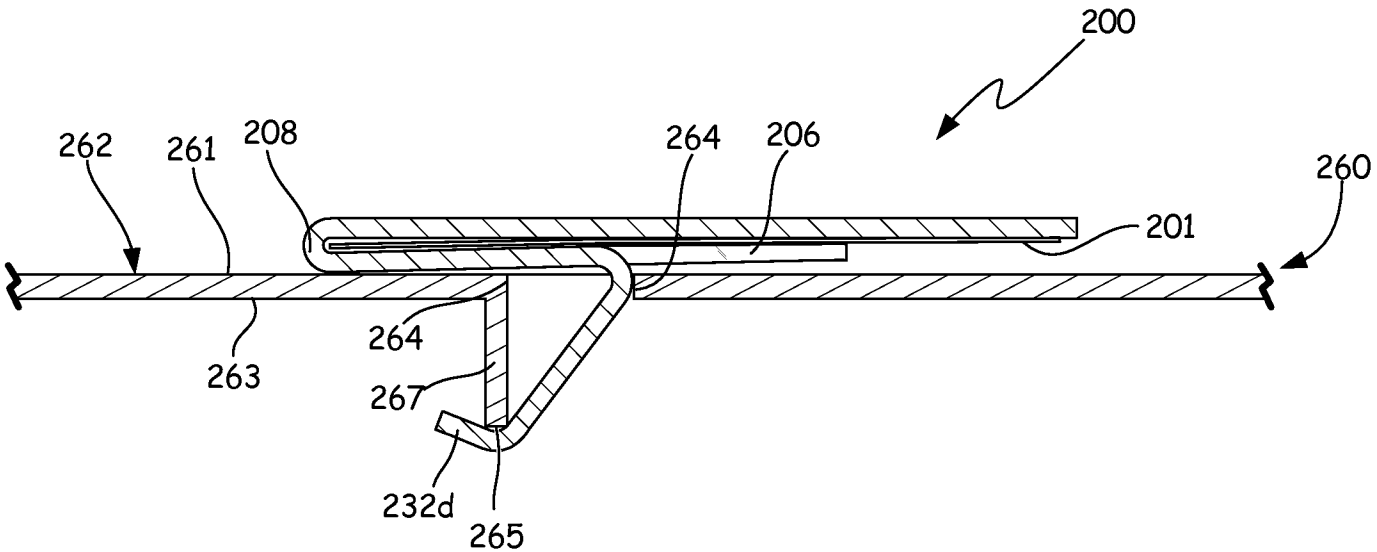
FIG. 20 is an enlarged section view of the sign holder and display apparatus taken through the line indicated in FIG. 19.
Figure 21:
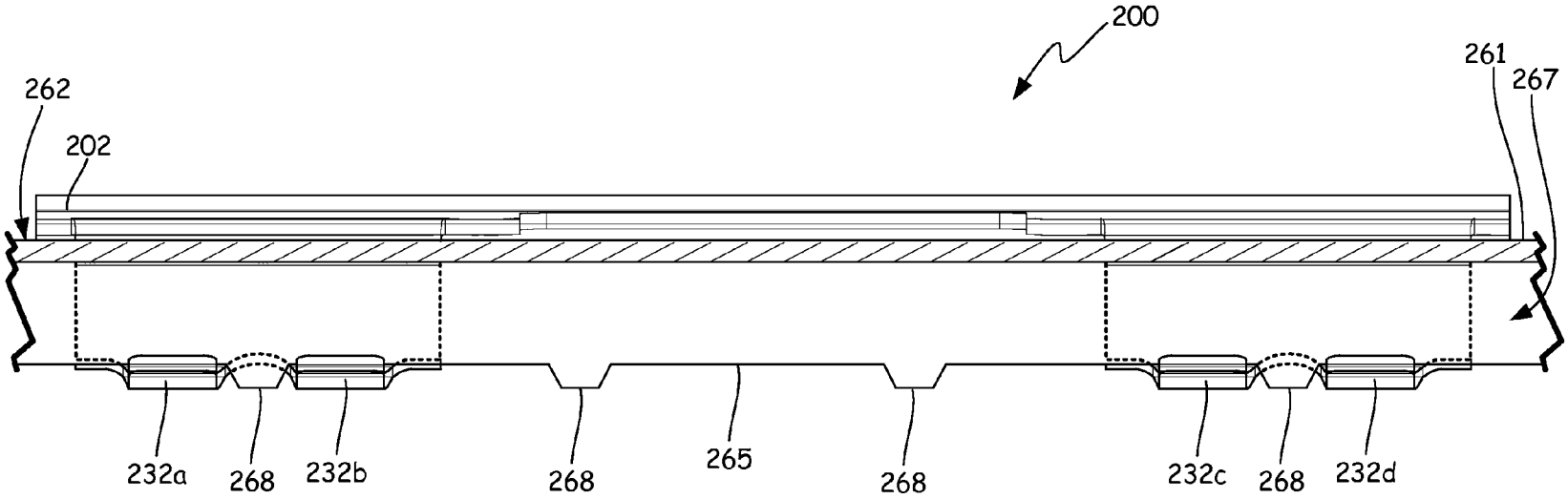
FIG. 21 is an enlarged section view of the sign holder and display apparatus taken through the line indicated in FIG. 19.
Figure 22:
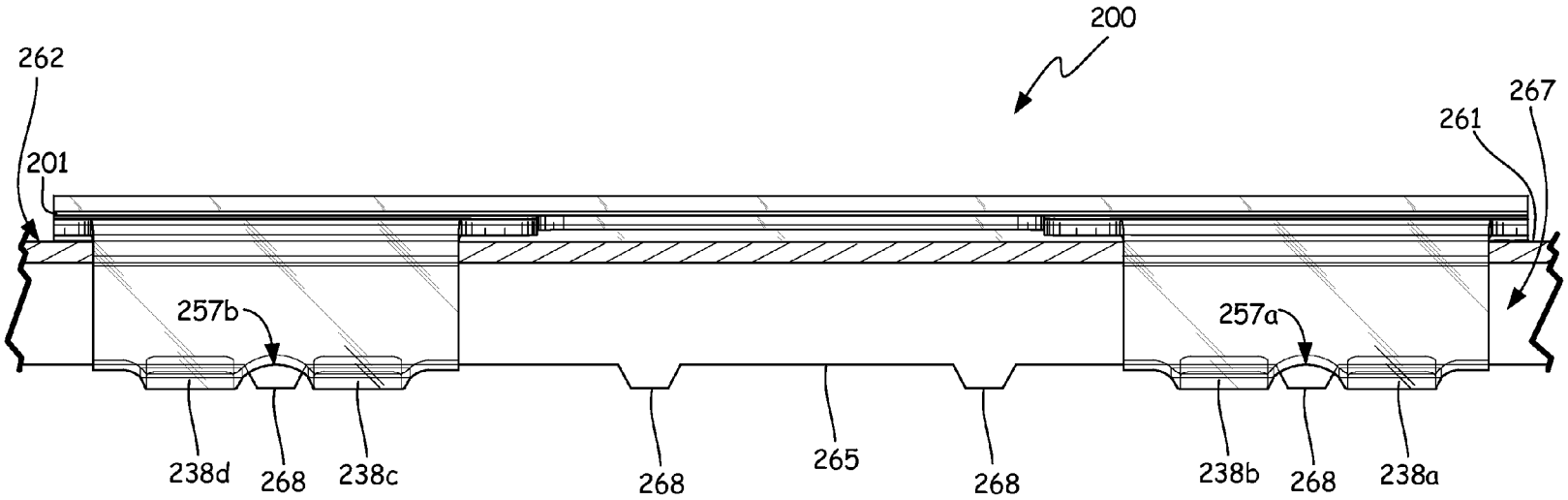
FIG. 22 is an enlarged section view of the sign holder and display apparatus taken through the line indicated in FIG. 19.

FIG. 19 illustrates a perspective view of an exemplary shelf-type display fixture 260 to which sign holders 200 can be attached for display. Display fixture 260 includes at least one table top or shelf 262 having a top surface 261. Table top or shelf 262 includes at least one slot 264 that extends therethrough (i.e., extends between top surface 261 and a bottom surface 263 of shelf 262 as illustrated in FIG. 20). Each sign holder 200 attaches to display fixture 260 by inserting protruding members or mounting portions 226*a* and 226*b* of sign holder 200 into one of the slots 264 until it snaps into a secured position. FIGS. 20-22 are sectional views of sign holder 200 and table top or shelf 262 taken through the lines indicated in FIG. 19 according to one embodiment. As illustrated in FIGS. 20-22, prongs 232*a-d* of protruding members or mounting portions 226*a* and 226*b* (of which prongs 232*a-c* are hidden from view in FIG. 20) engage with a bottom edge 265 of a protrusion 267. Each slot 264 includes an associated protrusion 267 that downwardly extends from bottom surface 263 of table top or shelf 262 and laterally extends along each slot 264. Still further, bottom edge 265 of each protrusion includes a plurality of spaced apart nubs or position keys 268. As illustrated in FIGS. 20-22, prongs 232*a* and 232*b*, which are coupled to leg 230*a* by joints 238*a* and 238*b*, straddle a nub or position key 268 so that curved edge 257*a* of leg 230*a* engages with the nub or position key as well as prongs 232*a* and 232*b* being positioned to curl around bottom edge 265. Prongs 232*c* and 232*d*, which are coupled to leg 230*b* by joints 238*c* and 238*d*, straddle a nub or position key 268 so that curved edge 257*b* of leg 230*b* engages with the nub or position key as well as prongs 232*a* and 232*b* being positioned to curl around bottom edge 265. This snap-fit engagement prevents sign holder 200 from sliding laterally along slot 264 and prevents sign holder 200 from being rotated within slot 264. It should be realized that prongs 232*a-d* as well as curved edges 257*a* and 257*b* can be used in other ways to secure sign holder 100 to shelf-type display fixture 260. To remove sign holder 200, access to underneath shelf or table top 262 will have to be gained so as to manually release prongs 232*a-d* from bottom edge 265 by pulling down on prongs 232*a-d*.

A method of altering display fixture 160 or 260 includes inserting at least one protruding member 126 or 226*a-b* of sign holder 100 or 200 into through slot 164 or 264 in a shelf or table top 162 or 262 of display fixture 160 or 260. The at least one hook portion 132*a-b* or 232*a-d* of the at least one protruding member 126 or 226*a-b* is engaged with bottom edge 165 or 265 of protrusion 167 or 267 that downwardly extends from a bottom surface of the shelf or table top 162 or 262 to hold sign holder 100 or 200 in place. Sign 101 or 201 is then inserted into sign sleeve 102 or 202 of the sign holder 100 or 200.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A sign holder comprising;

a sign sleeve being defined by a viewing flange, a base flange and a first joint that couples the viewing flange to the base flange, wherein the base flange includes a free end;

at least one protruding member having a distal end and being coupled to and extending from the base flange at an at least one second joint, each protruding member including a leg portion and at least two hook portions coupled to the leg portion at an at least one third joint, the leg portion being oriented relative to the base flange by a first angle and each hook portion being oriented relative to the leg portion by a second angle; and wherein a distal end of each hook portion is a part of the free end of the base flange.

2. The sign holder of claim 1, wherein a portion of an interior surface of the base flange is biased against at least a portion of an interior surface of the viewing flange so as to retain an in-store marketing sign in the sign sleeve.

3. The sign holder of claim 1, wherein a distal end of each protruding member is continuous with a free end of the base flange.

4. The sign holder of claim 3, wherein the distal end of each protruding member comprises at least one curved edge located between the at least two hook portions and the at least one curved edge engages with a portion of a display fixture.

5. The sign holder of claim 1, wherein the viewing flange, the base flange, the first joint, the at least one protruding member and the at least one second joint are made of a single, continuous piece of sheet material.

6. The sign holder of claim 1, wherein the first angle comprises an acute angle.

7. The sign holder of claim 1, wherein the second angle comprises an obtuse angle.

8. The sign holder of claim 1, wherein the at least one protruding member comprises a first protruding member and a second protruding member, wherein the first protruding member is spaced apart from the second protruding member.

9. A sign holder comprising:

a single, continuous piece of sheet material having a first surface and an opposing second surface and comprising:

a main panel;

a return panel fixed to the main panel by a first bend and extending from the first bend to a free end, wherein a portion of the return panel is biased against a portion of the main panel so as to retain an in-store marketing sign in a pocket that is defined by the main panel, the first bend and the return panel; and wherein the return panel includes at least one mounting portion that is oriented out-of-plane from a remaining portion of the return panel by at least one second bend and extends from the at least one second bend to at least one distal end, wherein the second bend is located between the first bend and the free end of the return panel.

10. The sign holder of claim 9, wherein a portion of the first surface of the sheet material that is located along the return panel is biased against a different portion of the first surface of the sheet material that is located along the main panel.

11. The sign holder of claim 9, wherein each mounting portion of the return panel comprises a leg, at least one third bend and at least one prong, the leg being defined between the second bend and the at least one third bend and the at least one prong being defined between the at least one third bend and the distal end.

12. The sign holder of claim 11, wherein the first surface of the sheet material located along the leg of each mounting portion is oriented at an acute angle from the first surface of the sheet material located along a remaining portion of the return panel.

13. The sign holder of claim 11, wherein the first surface of the sheet material located along each prong of each mounting portion is oriented at an obtuse angle from the first surface of the sheet material located along the leg of each mounting portion.

14. The sign holder of claim 11, wherein an edge of the return panel comprises at least one curved edge located between two prongs, the at least one curved edge engages with a portion of a display fixture.

15. The sign holder of claim 9, wherein the main panel and the return panel comprise a width that is greater than a width of the at least one mounting portion.

16. The sign holder of claim 9, wherein the at least one mounting portion of the return panel comprises a first mounting portion and a second mounting portion, wherein the first mounting portion is spaced apart from the second mounting portion.

17. A method of altering a display fixture comprising:

inserting at least one protruding member of a sign holder into a through slot in a shelf of a display fixture, the sign holder including a sign sleeve defined by a viewing flange, a base flange and a first joint that couples the viewing flange to the base flange, wherein the at least one protruding member includes a leg portion coupled to the base flange by a second joint, at least one hook portion and at least one third joint that couples the leg portion to the at least one hook portion; and engaging the at least one hook portion of the at least one protruding member with a bottom edge of a protrusion that downwardly extends from a bottom surface of the shelf to hold the sign holder in place.

18. The method of claim 17, further comprising inserting a sign into the sign sleeve of the sign holder.

19. The method of claim 18, wherein inserting the sign into the sign sleeve of the sign holder comprises inserting the sign into one of a pair of opposing sides of the sign sleeve or a top side of the sign holder.

20. The method of claim 17, wherein engaging the at least one hook portion of the at least one protruding member with the bottom edge of the protrusion that downwardly extends from the bottom surface of the shelf further comprises engaging at least one curved edge that is located between two hook portions of the at least one protruding member with a nub that is located on the bottom edge of the protrusion.

* * * * *